US011033910B2

(12) United States Patent
Schmacker et al.

(10) Patent No.: US 11,033,910 B2
(45) Date of Patent: Jun. 15, 2021

(54) WIRE MEMBER AND METHOD OF MAKING WIRE MEMBER

(71) Applicant: SCHMACKER INVESTMENTS PTY LTD, Queensland (AU)

(72) Inventors: Paul Graeme Schmacker, Queensland (AU); Mark Barry Schmacker, Queensland (AU)

(73) Assignee: SCHMACKER INVESTMENTS PTY LTD.

( * ) Notice: Subject to any disclaimer, the term of this patent is extended or adjusted under 35 U.S.C. 154(b) by 134 days.

(21) Appl. No.: 16/329,736

(22) PCT Filed: Aug. 30, 2017

(86) PCT No.: PCT/AU2017/050925
§ 371 (c)(1),
(2) Date: Feb. 28, 2019

(87) PCT Pub. No.: WO2018/039719
PCT Pub. Date: Mar. 8, 2018

(65) Prior Publication Data

US 2019/0240679 A1 Aug. 8, 2019

(30) Foreign Application Priority Data

Aug. 30, 2016 (AU) ..... 2016903443

(51) Int. Cl.
*B04B 7/18* (2006.01)
*B07B 1/22* (2006.01)
(Continued)

(52) U.S. Cl.
CPC ..... *B04B 7/18* (2013.01); *B07B 1/12* (2013.01); *B07B 1/14* (2013.01); *B07B 1/22* (2013.01);
(Continued)

(58) Field of Classification Search
CPC .... B04B 7/08; B04B 7/16; B04B 7/18; B07B 1/12; B07B 1/14; B07B 1/22; B07B 1/4618; B07B 2230/01
See application file for complete search history.

(56) References Cited

U.S. PATENT DOCUMENTS 2,526,475 A 10/1950 Glesmann
3,123,557 A * 3/1964 McPhee et al. ..... B04B 3/00 210/382
(Continued)

FOREIGN PATENT DOCUMENTS

DE 19502572 A1 * 8/1996 ..... B04B 3/02
EP 0061539 A1 10/1982
(Continued)

OTHER PUBLICATIONS

International Search Report and Written Opinion dated Oct. 9, 2017 for PCT/AU2017/050925.

*Primary Examiner* — Bradley R Spies
*Assistant Examiner* — Jeannie McDermott
(74) *Attorney, Agent, or Firm* — David Meibos; Maywood IP Law

(57) ABSTRACT

A screen basket for centrifuges having a wedge wire with a broad end and an opposite narrow end. The wedge wire narrows in width from the broad end to the narrow end and the wedge wire increases in depth from the broad end to the narrow end.

4 Claims, 14 Drawing Sheets

(51) Int. Cl.
*B07B 1/14* (2006.01)
*B07B 1/46* (2006.01)
*B07B 1/12* (2006.01)

(52) U.S. Cl.
CPC ..... *B07B 1/4618* (2013.01); *B07B 2230/01* (2013.01)

(56) References Cited

U.S. PATENT DOCUMENTS

| | | | | |
|---|---|---|---|---|
| 3,491,888 | A * | 1/1970 | Benson | B04B 7/16 210/380.1 |
| 4,487,695 | A | 12/1984 | Connolly | |
| 4,569,761 | A * | 2/1986 | Spiewok | B04B 7/16 210/380.1 |
| 5,378,364 | A | 1/1995 | Welling | |
| 6,736,968 | B2 * | 5/2004 | Mullins | B04B 3/04 210/232 |
| 2010/0263819 | A1 | 10/2010 | Maurais | |

FOREIGN PATENT DOCUMENTS

| | | | |
|---|---|---|---|
| EP | 0494708 | A1 | 7/1992 |
| GB | 2282763 | A | 4/1995 |
| JP | S5861911 | A | 4/1983 |

* cited by examiner

WIRE MEMBER AND METHOD OF MAKING WIRE MEMBER

CROSS-REFERENCE TO RELATED APPLICATIONS

The present application is a National Stage of International Application No. PCT/AU2017/050925, filed on Aug. 30, 2017, which claims the benefit of Australian Application No. 2016903443, filed on Aug. 30, 2016. All of the foregoing are incorporated as though set forth herein in their entirety.

FIELD OF THE INVENTION

The present invention relates generally to the manufacture and use of wire members used in separating centrifuges. Separating centrifuges are commonly used in many sorting and dewatering processes. More specifically the invention relates to wedge wire used in improved screen baskets for use in separating centrifuges.

BACKGROUND TO THE INVENTION

Centrifuges, such as screen scroll centrifuges, are often used to filter or dewater crystalline or amorphous solid/liquid slurries. These centrifuges typically utilize a screen to separate the solid portion of the slurry from the liquid phase. The screen, moreover, is typically sized to retain the larger solids portion of the slurry while allowing the liquid to pass through and thus, the two phases of the slurry may be separately collected. Instead of relying on gravity to filter the slurry through the screen, however, filtration occurs under large centrifugal forces (on the order of many times the force of gravity), caused by high rotational speed of the centrifuge. These large centrifugal forces substantially increase the separation efficiency of the centrifuge.

Specifically, the slurry is delivered to the interior of a rotating basket that includes a frusto-conical screen body. The screen body is typically formed from a plurality of wedge wires that are spaced side-by-side. For structural support, the wedge wires may be welded to circumferential ribs spaced out along the rotational axis of the body. Rotation of the screen basket drives the slurry against the inner surface of the body and the liquid phase is forced through the slots formed between adjacent wedge wires. The larger solid particles do not pass through the slots and are instead collected on the inside of the basket.

To convey the solids out of the inside of the basket, a scroll conveyor having a helical blade is typically mounted concentrically within the basket. The tip of the blade, however, is spaced from the inner surface of the basket by a small radial clearance. The scroll conveyor is rotated in the same direction as the basket but at a slightly different rotational speed relative to the basket. Through this differential speed, the solids accumulating along the inside surface of the basket are conveyed by the helical blade from the small diameter end and toward the basket's larger end where they are dumped in a discharge chute and collected.

Another type of separating centrifuge is a vibrating centrifuge. Vibrating centrifuges also include a screen basket that is similar in design to the basket of screen scroll centrifuges. A vibrating centrifuge, however, does not utilize a helically bladed scroll to move the solid particles collecting on the inside surface of the basket to the discharge chute. Instead, the vibrating centrifuge includes a mechanism for shaking the basket back-and-forth along its axis. By shaking or vibrating the basket along its rotational axis, solid particles accumulating on the inside of the basket are conveyed axially toward the discharge chute and collected.

Therefore, as described above, scroll and vibrating centrifuges are very useful for separating liquid/solid slurries. Nonetheless, these centrifuges are subject to significant wear requiring frequent maintenance and corresponding down time. For example, solid particles of the slurry often get trapped in the slots of the basket, damaging the screen and reducing the separation efficiency of the centrifuge. Furthermore, the slurries often include highly abrasive components that wear out the body of the screen basket. The corresponding maintenance and replacement of parts significantly increase operating costs.

A conventional method of manufacture of the centrifuge baskets described above includes manufacture of the body from stainless steel wedge wire cut from flat sheets. Commonly, wedge wires are arranged as a screen cylinder which is then split and flattened into a sheet form. The frusto-conical body forming the basket is then developed and a layout made on this flat wedge wire sheet. To minimize the material used, the body is usually divided into several sections. Each section is cut from the flat sheet and rolled into a frusto-conical shape. A set of panels is placed on an appropriate jig and welded into the required complete frusto-conical form. However, when the sections are joined to form a body, the welded joints located between each adjacent section end up having a "herring bone" or V shaped pattern similar to the V shaped pattern found in twill fabric.

This also results in a cone with slots on the inside of the basket running in a relatively vertical pattern (i.e., slots are in the general longitudinal direction of the cone).

The inner surface of the body is produced by wedge wires which are welded to a network of support rods at the exterior of the body. The support rods run at right angles to the internal wedge wires and generally run circumferentially on the outside of the basket. The wedge wires have a wedge shaped cross sectional shape. An example of such a basket is described in U.S. Pat. No. 4,487,695.

However, in this arrangement, there is usually only one wire in each section which is parallel to the rotation axis of the body. This cannot be avoided using current materials and techniques. This means that for reasons explained hereinafter that as the particles in mine slurries (e.g. coal slurries) travel outwardly of the centrifugal basket due to centrifugal force and vibration, some coal particles will cut across the wedge wires, resulting in excessive wear and premature failure of the basket.

To complete a useable basket, mounting flanges of various styles are welded to the ends of the basket body and often there are reinforcing ribs and, depending on design, strengthening and wear plates added.

Thus, the manufacture of a screen basket involves a number of processes, is time consuming and labour intensive and the quality of the end product is dependent on the skill of personnel involved in the manufacturing. In a large part, the time and expense in building a screen basket is brought about by the method of fabricating the body of the basket from a number of panel sections. Depending on the size of the basket, the process of cutting these panel sections from flat sheet can also be wasteful of expensive stainless steel materials.

Another problem with the conventional centrifuge baskets as described above is that they did not process coal slurries in an efficient manner. In this regard coal generally has a stratified form and thus, in other words, has a laminar structure. Thus, in use coal may travel from a smaller diameter end of the centrifuge basket to a larger diameter end. However, due to its structure, coal tends to split into smaller particles or dust. The presence of the herring bone pattern in the welded joints between each section of the body as described above also was detrimental to the coal particles as it tended to cut the coal particles. In this regard, it was necessary that the coal particles were caused to travel on the internal surfaces of each longitudinal wedge wire to avoid fracturing. Therefore because of the herring bone pattern in each welded joint it was necessary to spin the centrifuge at 300 rpm to introduce vibration into movement of the basket to facilitate the coal particles to travel on the internal surfaces of each wedge wire. However, such vibration also resulted in fracturing of the coal particles.

OBJECT OF THE INVENTION

It is an object of the invention to overcome or at least alleviate one or more of the above problems and/or provide the consumer with a useful or commercial choice.

SUMMARY OF THE INVENTION

In one form, although it need not be the only or indeed the broadest form, the invention resides in a screen basket for centrifuges comprising a wedge wire having a broad end and an opposite narrow end, wherein the wedge wire narrows in width from the broad end to the narrow end.

The wedge wire may increase in depth from the broad end of the wedge wire to the narrow end of the wedge wire.

The wedge wire suitably has a generally triangular-shaped profile in cross-section.

The degree of narrowing may be uniform over the length of the wedge wire.

The wedge wire may have a flat planar head face having edges between which the width of the wedge wire is defined. The head face tapers inwardly from the broad end of the wedge wire to the narrow end of the wedge wire.

In another form, the invention resides in a screen basket for centrifuges, the screen basket having a body of frusto-conical shape, the body including a plurality of wire members and a number of support rods, wherein each wire member is oriented in a common plane with a rotational axis of the body and the support rods are oriented circumferentially of the body and there are longitudinal slots located between adjacent wire members.

The wire members suitably have a broad end and an opposite narrow end, wherein the wire members narrow in width from the broad end to the narrow end.

The wire members may be wedge wires as defined and described in the first form of the invention.

The support rods may have a plurality of teeth spaced around an annulus of the support rod, wherein each pair of adjacent teeth defines a recess for receiving a wire member.

The longitudinal slots may have a constant width. Alternatively, the longitudinal slots may have a varying width.

In yet another form, the invention resides in a method of manufacture of a screen basket for centrifuges, the method including:

feeding a feed wire between rollers in a rolling operation;

gradually displacing at least one of the rollers closer to an adjacent roller as the feed wire is fed between the rollers to form a wedge wire; and forming a centrifuge basket from the wedge wire.

A rolling machine for forming a wedge wire from a feed wire includes two rollers which are displaced relative to each other as the feed wire is fed between the rollers.

Each roller may have a rotational axis and a groove which has a floor inclined relative to the rotational axis.

The rolling machine includes a controller which controls the rate of displacement of the rollers relative to each other as the feed wire is fed between the rollers. The controller also controls the rate of feed of the feed wire by controlling the rotation of at least one of the rollers.

BRIEF DESCRIPTION OF THE DRAWINGS

To assist in understanding the invention and to enable a person skilled in the art to put the invention into practical effect, exemplary embodiments of the invention will be described by way of example only with reference to the accompanying drawings, wherein:

FIG. 1A is a side view of the wedge wire shown in FIG. 1;

DETAILED DESCRIPTION OF THE DRAWINGS

Figure 1:
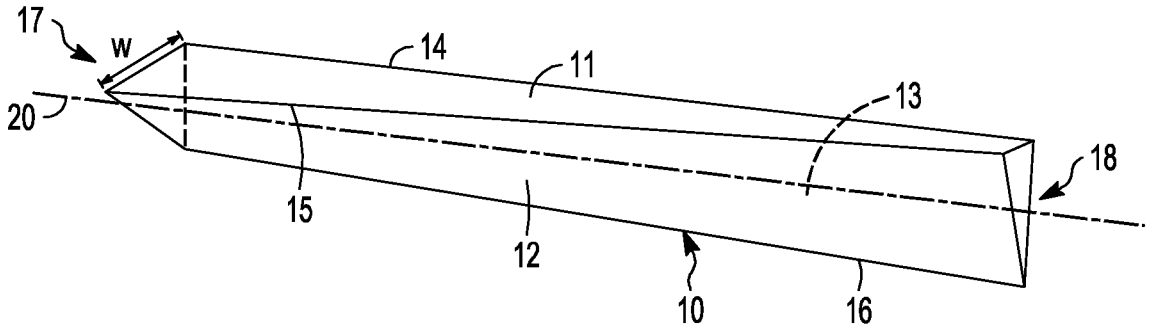
FIG. 1 is a perspective view of a wire member in the form a wedge wire in accordance with the invention.

In this patent specification, adjectives such as first and second, left and right, top and bottom, etc., are used solely to define one element or method step from another element or method step without necessarily requiring a specific relative position or sequence that is described by the adjectives. Words such as "comprises" or "includes" are not used to define an exclusive set of elements or method steps. Rather, such words merely define a minimum set of elements or method steps included in a particular embodiment of the present invention. In the drawings, like reference numerals refer to like parts.

Figure 2:
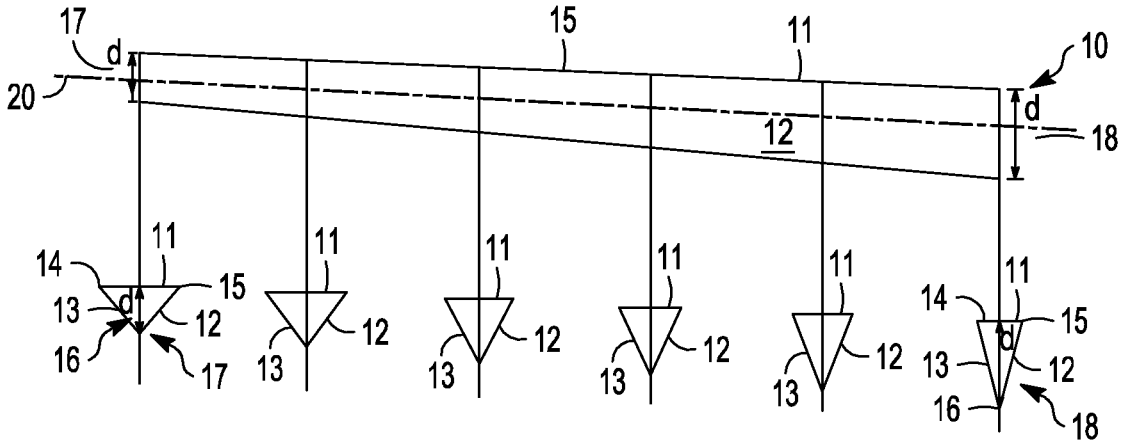
FIG. 2 is a series of cross-sectional views along the wedge wire shown in FIG. 1.

FIG. 1 shows a perspective view of a wire member in accordance with one embodiment of the invention. The wire member is in the form of a wedge wire 10 of a screen basket (shown in FIG. 5) for centrifuge. It will be noted from FIG. 1 that the wedge wire 10 is of a triangular-shaped cross-section as shown in FIG. 2. The wedge wire 10 is used in the manufacture of a centrifugal screen basket.

The wedge wire 10 has three planar faces, namely head face 11 and two side faces 12, 13. Head face 11 has edges 14 and 15 which are common with side faces 12 and 13. A head width (w) of the wedge wire 10 is defined across the head face 11 extending between the edges 14 and 15. The head width (w) is measured perpendicularly to the longitudinal axis 20 of the wedge wire 10.

The wedge wire 10 has a broad end 17 and a narrow end 18. It will be noted that edges 14 and 15 of head face 11 taper or converge inwardly from the broad end 17 to the narrow end 18. That is to say the head width (w) decreases from the broad end 17 to the narrow end 18.

The side faces 12 and 13 share a common edge 16. A depth (d) of the wedge wire 10 is defined as the shortest distance from the edge 16 to the head face 11. In regard to side face 12, side edges 15 and 16 taper or diverge outwardly from end 17 to end 18. In regard to side face 13, side edges 14 and 16 taper or diverge outwardly from end 17 to end 18. That is to say the depth (d) increases from the broad end 17 to the narrow end 18.

The broad end 17 is in the shape of approximately an isosceles triangle and narrow end 18 is also approximately in the shape of an isosceles triangle. The narrow end 18 thus has a greater depth (d) than broad end 17, which has a greater width (w).

Figure 3:
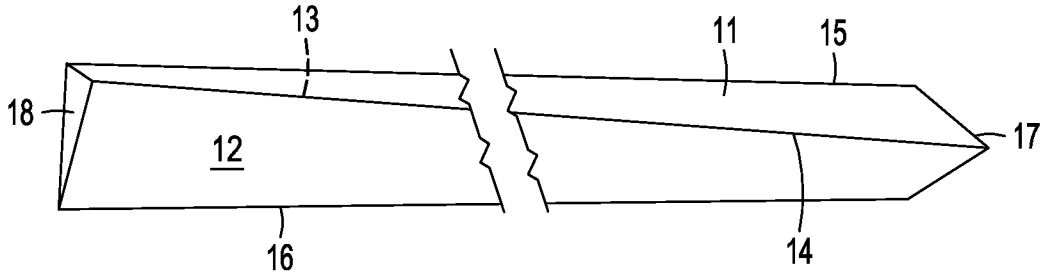
FIGS. 3 and 4 are perspective views of the wedge wire shown in FIG. 1 from each end of the wedge wire, respectively.
Figure 4:
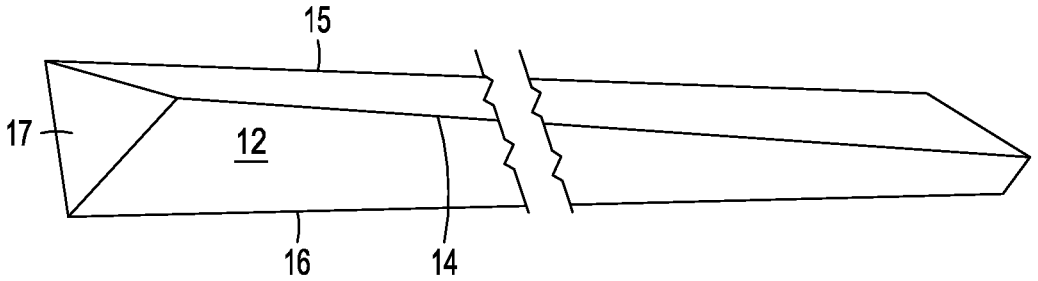

FIGS. 3 and 4 show different isometric views of wedge wire 10 from each of the different ends 17 and 18. The wedge wire 10 is indefinite in length although FIGS. 1-2 indicate a finite length for convenience.

Figure 5:
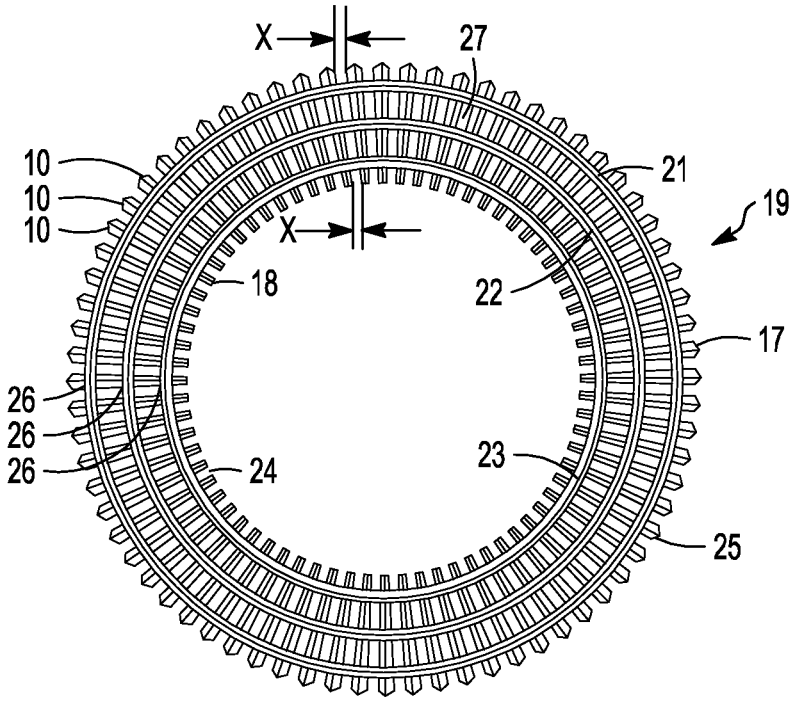
FIGS. 5, 6 and 7 show a side view, plan view and perspective view of the body of a screen basket including a multiplicity wedge wires of FIG. 1.
Figure 6:
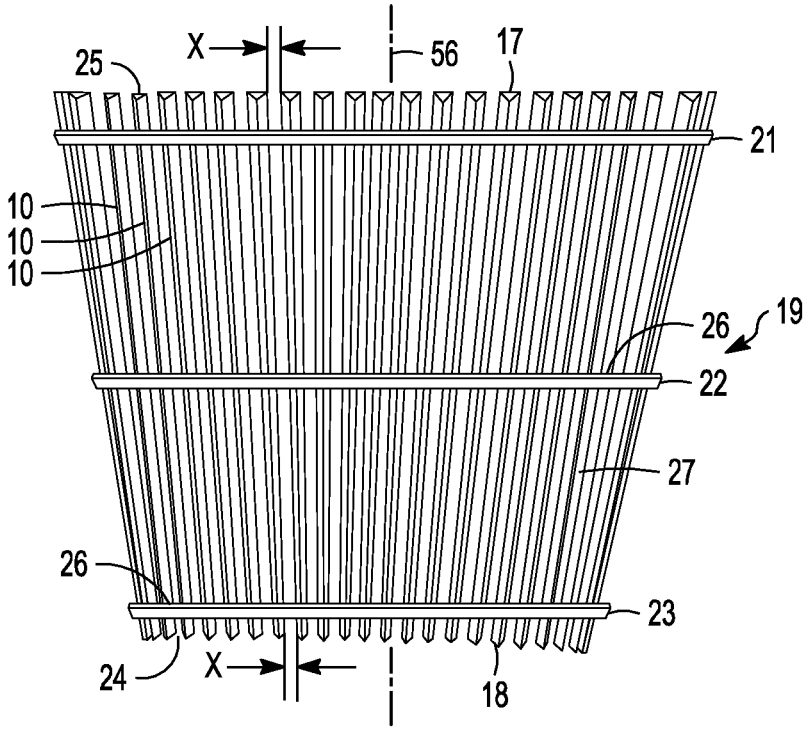
Figure 7:
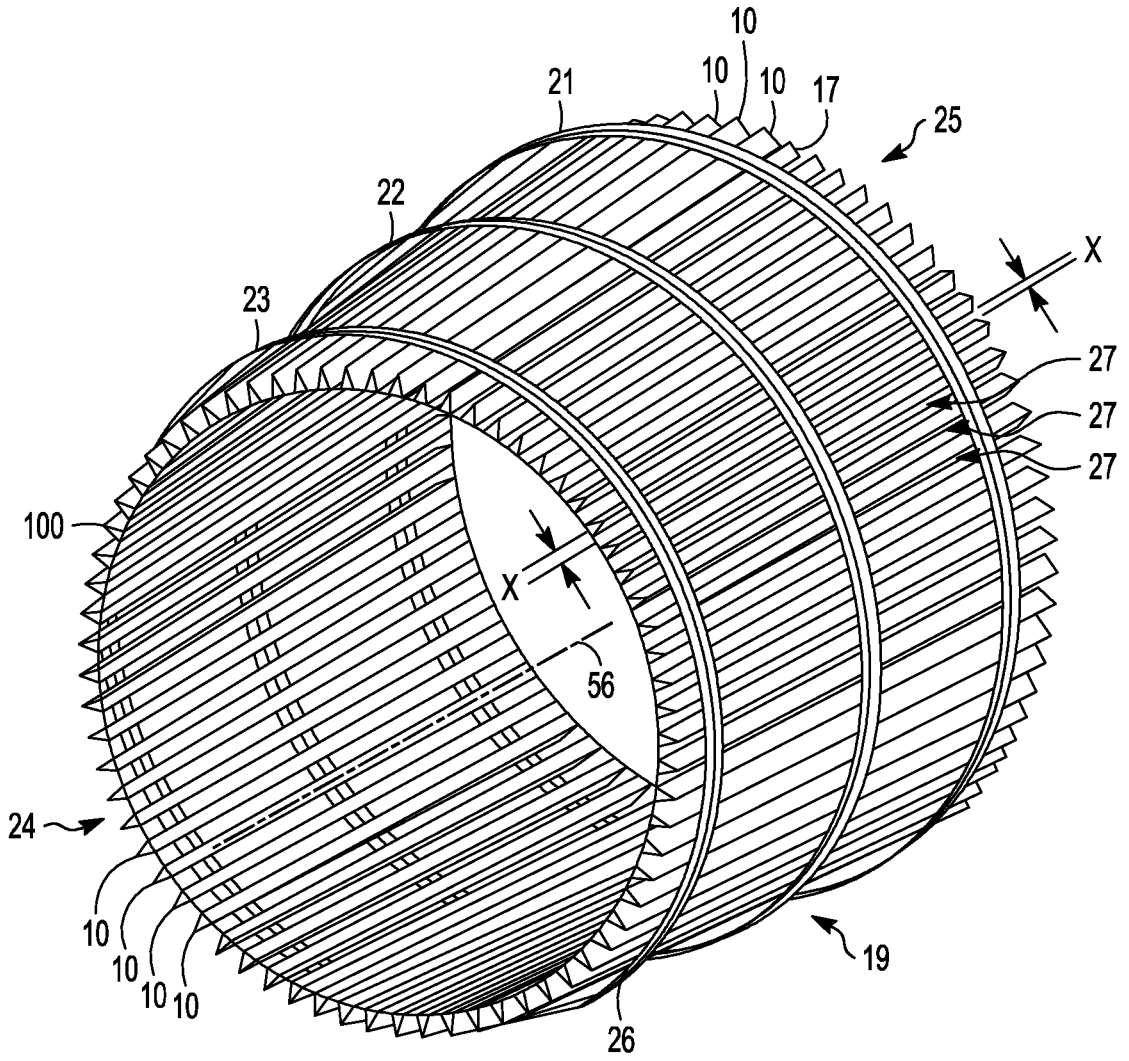

FIGS. 5, 6 and 7 show the body 19 of a centrifuge screen basket. The body 19 includes wedge wires 10 described in FIGS. 1-4. It will be appreciated that the body 19 has a plurality of wedge wires 10 and also a plurality of support hoops 21, 22 and 23 comprising support rods.

The body 19 has a frusto-conical shape (truncated cone) as shown, having a smaller diameter end 24 and a larger diameter end 25. The wedge wires 10 are circumferentially spaced about a rotational axis 56 of the body 19. Each of the wedge wires 10 are welded to support hoops 21, 22 and 23 at points 26. There are also provided longitudinal or axially oriented slots 27 between adjacent wedge wires 10 having a constant width as shown by distance "X" in FIGS. 5, 6 and 7. It will also be noted that narrower ends 18 of each wedge wire 10 are located on the smaller diameter end 24 and broader ends 17 are located on the larger diameter end 25. Furthermore, it will be appreciated that the slots may have a tapered width or varying width between adjacent wedge wires 10. This varying width can be achieved by having the narrower ends 18 of each wedge wire 10 located on the larger diameter end 25 and the broader ends 17 on the smaller diameter end 24. The varying width can also be achieved by placing adjacent wedge wires 10 so that one wedge wire 10 has a narrower end 18 located on the larger diameter end 25 and broader end 17 on the smaller diameter end 24 and an adjacent wedge wire 10 has a narrower end 18 located on the smaller diameter end 24 and a broader end 17 on the larger diameter end 25.

The wedge wires 10 and each longitudinal slot 27 are in a common plane with the rotational axis 56 of the body 19.

Figure 8:
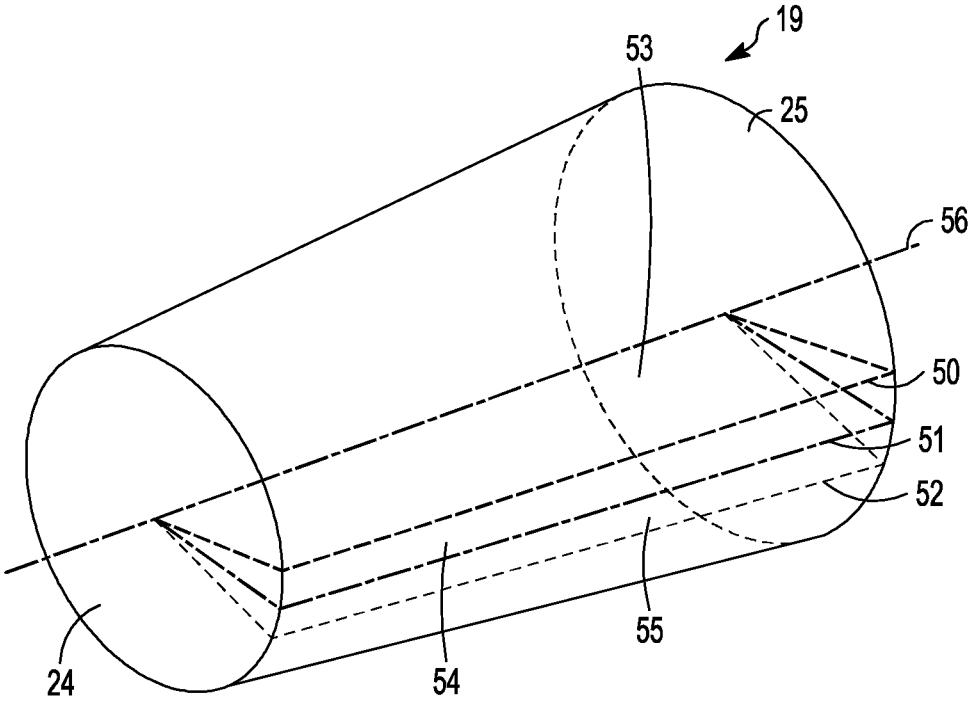
FIG. 8 is a perspective view of the geometry of the body of FIGS. 5-7.

FIG. 8 shows wedge wires 10, or slots 27, represented by lines in phantom 50, 51 and 52 each of which form a common plane 53, 54 and 55 with rotational axis 56 of the body 19.

In the case that lines 50, 51 and 52, represent wedge wires 10, the longitudinal axis 20 of each wedge wire 10 will lie on one of the lines 50, 51 and 52.

End faces of the wedge wires 10 at their narrow ends 18 are to square to the rotational axis 56. Similarly, the end faces of the wedge wires at their broad ends 17 are square to the rotational axis 56.

Figure 9:
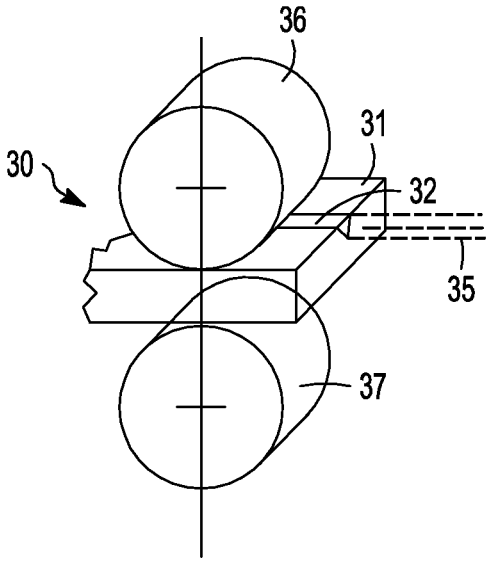
FIG. 9 is a perspective view of one embodiment of a rolling operation to form the wedge wire of FIG. 1.

One method of manufacturing wedge wire 10 is described in FIG. 9, wherein preformed feed wire 35 is rolled in a die plate 31. The feed wire 35 has a constant triangular cross-section in the shape of approximately an isosceles triangle. The die plate 31 has a continuous longitudinal groove 32 which has a shape which is complementary to the wedge wire 10. The groove 32 thus has a constantly changing triangular shape as shown in FIGS. 10 and 11.

Figures 10, 11:
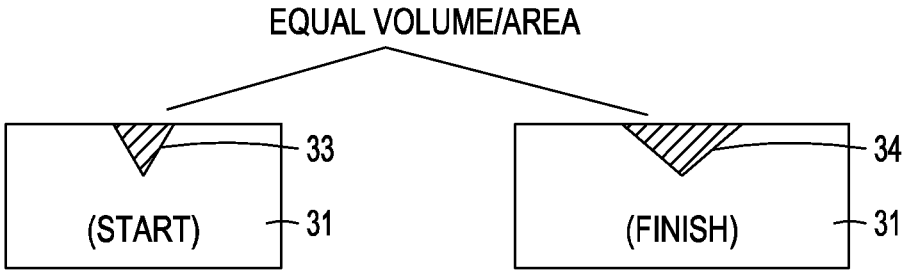
FIG. 10 is an end view of a jig used in the rolling operation of FIG. 9.
FIG. 11 is a different end view of the jig of FIG. 10.

FIG. 10 shows an end 33 of the groove 32 in the die plate 31 which corresponds with the narrow end 18 of the wedge wire 10.

FIG. 11 shows an end 34 of the groove 32 which corresponds with the broad end 17 of the wedge wire 10.

The process includes an initial step of placing annealed feed wire 35 in groove 32 as shown in phantom in FIG. 9 and moving die plate 31 between opposed rollers 36 and 37. The feed wire 35 after passage through rollers 36 and 37 will be the wedge wire 10 having the cross-sectional shape as shown in FIGS. 1-4.

Figure 12:
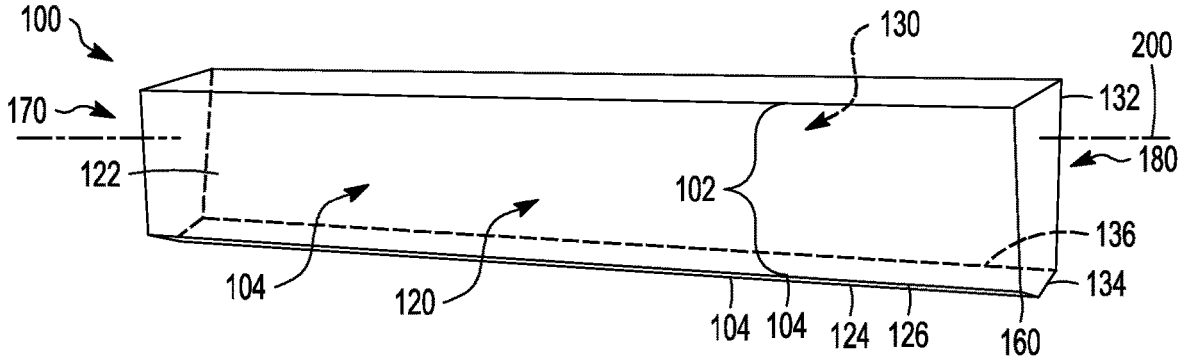
FIG. 12 is a perspective of another embodiment of a wedge wire in accordance with the invention.
Figure 13:
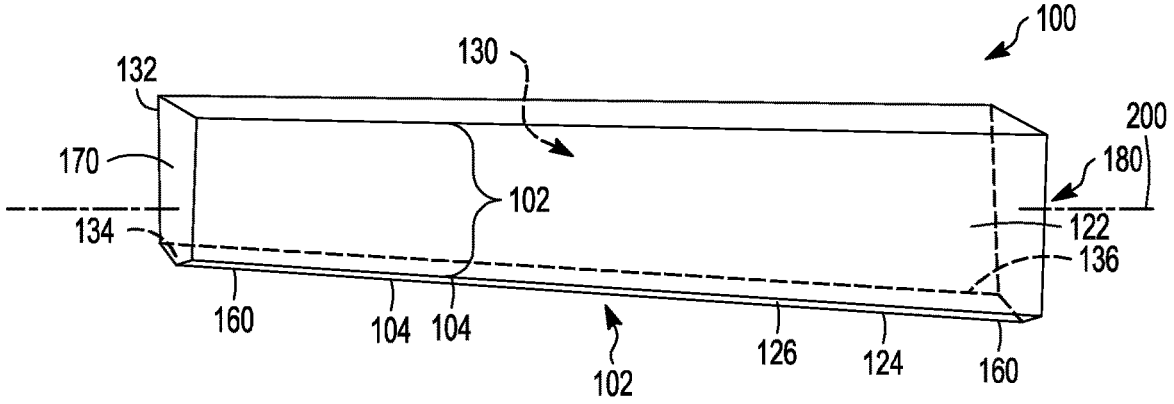
FIG. 13 is a different perspective view of the wedge wire of FIG. 12.
Figure 14:
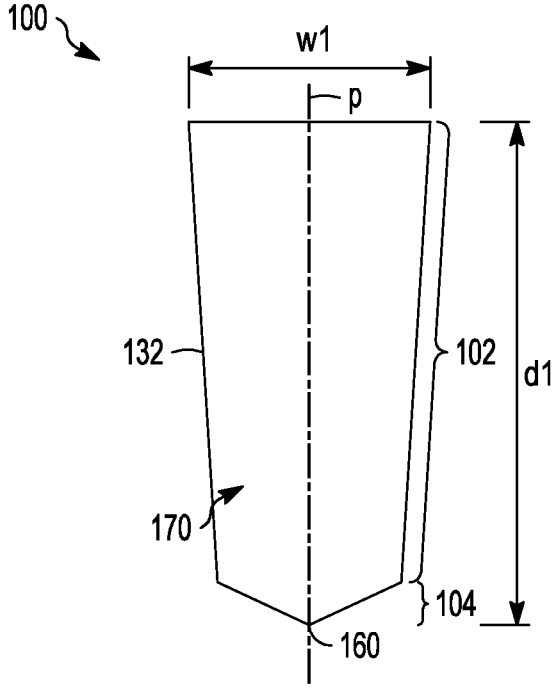
FIG. 14 is an end view of the broad end of the wedge wire of FIG. 12.
Figure 15:
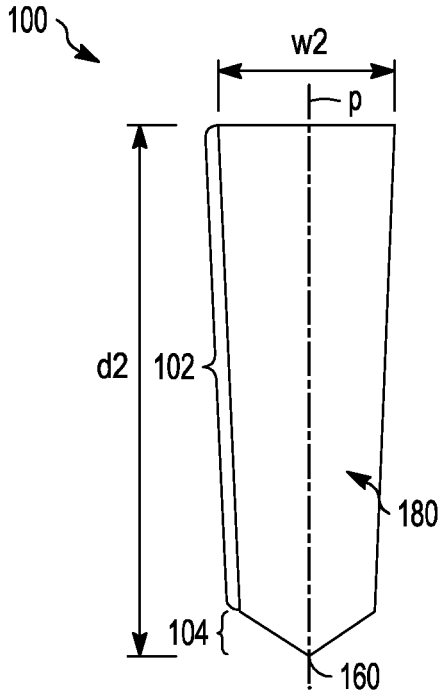
FIG. 15 is an end view of the narrow end of the wedge wire of FIG. 12.

FIG. 12 shows an elongate wire member in the form of wedge wire 100. The wedge wire 100 is another embodiment of a wire member in accordance with the invention. The wedge wire 100 is similar to the wedge wire 10, with the main difference being that side faces 120, 130 of wedge wire 100 each comprise two planar surfaces as discussed below.

The side face 120 of wedge wire 100 has a body surface 122 and a nose surface 124. The body surface 122 and nose surface 124 are contiguous along an edge 126. The flat plane of the body surface 122 is angled relative to the flat plane of the nose surface 124. Similarly, the side face 130 of wedge wire 100 comprises a body surface 132 and a nose surface 134. The body surface 132 and nose surface 134 are contiguous along an edge 136. The flat plane of the body surface 132 is angled relative to the flat plane of the nose surface 134.

The nose surfaces 124 and 134 share a common leading edge 160 of the wedge wire 100.

A nose 102 of the wedge wire 100 is defined between the nose surfaces 124 and 134. A body 104 of the wire 100 is defined between the body surfaces 122, 132. The wedge wire 100 is symmetrical about a symmetrical plane (p) extending square from the head face 110 to the leading edge 160. The symmetrical plane (p) extends through a longitudinal axis 200 of the wedge wire 200.

The body surfaces 122, 132 are slanted at about a 3 degree angle to the symmetrical plane (p) along the whole of the wire 100. Although an approximately 3 degree angle may be advantageous, it will be appreciated that the angle could be of varying degrees. The angle may advantageously fall within the range of 1 degree to 15 degrees, and more particularly in the range of 1 degree to 10 degrees, and even more particularly in the range of 1 degree to 6 degrees, and still more particularly between about 2 degrees and about 4 degrees.

The depth (d) of the wedge wire 100 increases from the broad end 170 to the narrow end 180. As such, depth $d_1$ measured at the broad end 170 is shallower than depth $d_2$ measured at the narrow end 180. In order for the depth to increase and the body surfaces 122, 132 to remain at around 3 degrees, the body 104 elongates in the depth direction.

The head width (w) decreases from the broad end 170 to the narrow end 180. The head width $w_1$ measured at the broad end 170 is thus wider than the head width $w_2$ measured at the narrow end 180.

The wedge wires 10 of the screen basket body 19 depicted in FIGS. 5 to 8 may be substituted by wedge wires 100.

Figure 16:
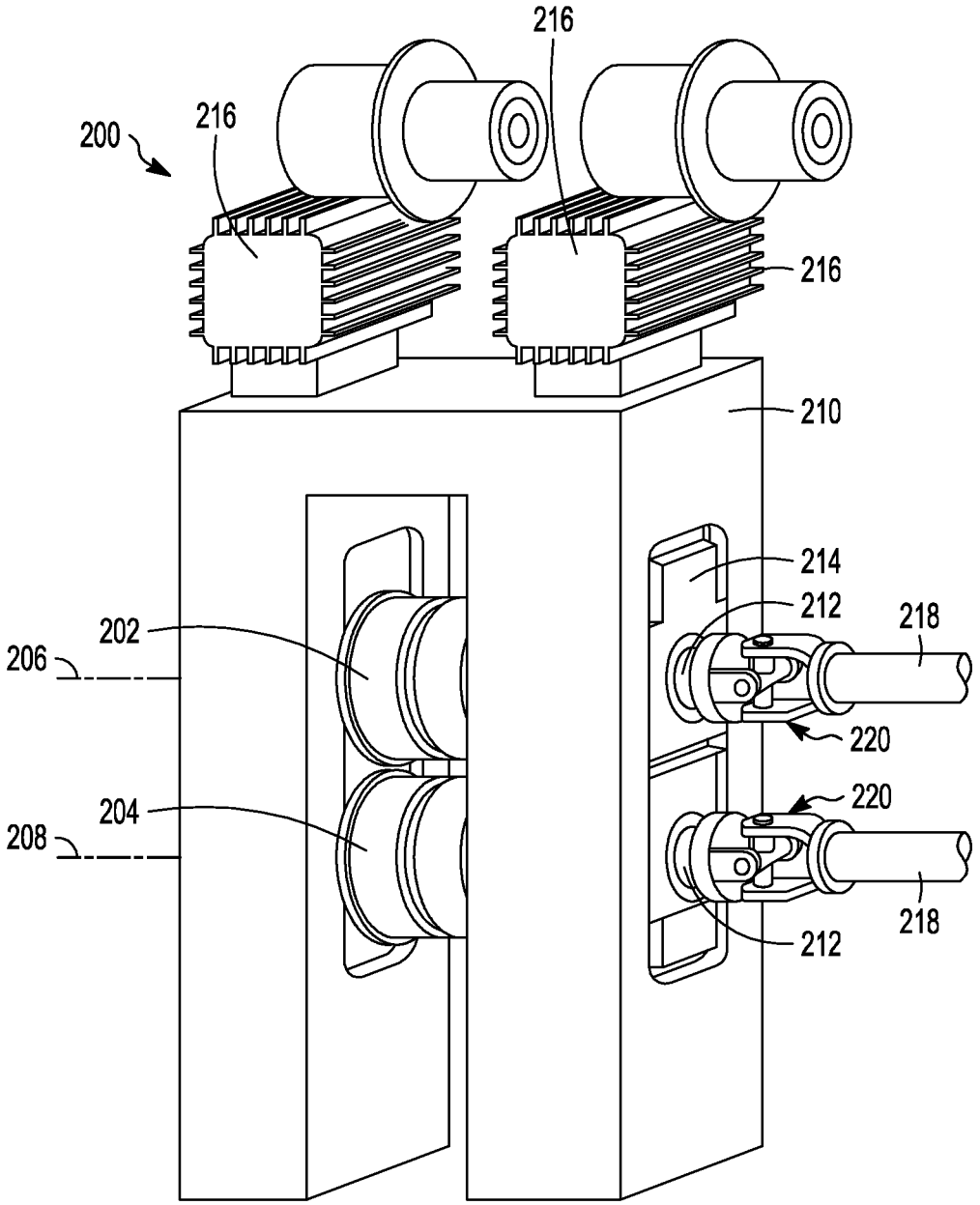
FIG. 16 is a perspective view of part of a rolling machine for forming the wedge wire of FIG. 12.

The wedge wire 100 is formed from constant cross-section feed wire using a rolling process. FIG. 16 shows part of a rolling machine 200 for forming the wire 100. The rolling machine 200 includes an upper roller 202 and a lower roller 204. The upper roller 202 has a rotational axis 206 and the lower roller 204 has a rotational axis 208. The rotational axes 206, 208 of the rollers 202, 204 are parallel to one another. The rollers 202, 204 are held relative to each other in a frame 210.

The upper roller 202 is selectively displaceable in the frame 210 relative to the lower roller 204 so that the spacing between the rotational axes 206, 208 vary. Even though the spacing between the axes 206, 208 may vary, the rotational axes 206, 208 remain parallel.

The upper roller 202 is displaced upwardly or downwardly by electric motors 216 of the rolling machine 100 mounted on top of the frame 210. The rollers 202, 204 have axles 212. The axle 212 of the upper roller 202 is journaled at either end in a block 214. The blocks 214 are movable up and down in the frame 210. The motors 216 rotate screws which engage the blocks 216 to translate the blocks 214 up and down in the frame 210.

The axles 212 are driven via drive shafts 218. The drive shafts 218 are connected to the axles 212 via universal joints 220. The universal joints 220 allow the upper roller 202 to be displaced while still driving the axle 212 of the upper roller 202.

It will be appreciated that although the upper roller 202 has been described as being displaceable, the lower roller 204 may also be displaceable. Either way, the upper roller 202 and the lower roller 204 are displaceable relative to each other.

The speed of rotation of the drive shafts 218, govern the rate of feed of wedge wire between the rollers 202, 204. The drive shafts 218 are driven by a hydraulic motor (not shown).

Figure 17:
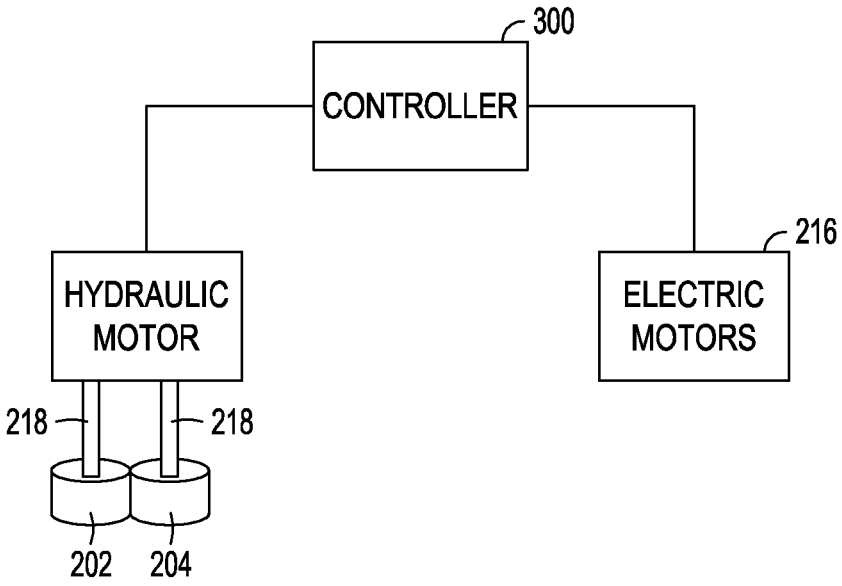
FIG. 17 is a diagram of the rolling machine of FIG. 16.

FIG. 17 shows a diagram of the rolling machine 200 and its control by a controller 300 of the machine 200. The speed of rotation of the drive shafts 218 is controlled by a controller 300 which controls motor 222. Displacement of the upper roller 202 is also controlled by the controller 300. Specifically, the controller controls the electric motors 216. The controller 300 thus controls the taper of the wire 10 over the length of the wire 10 by controlling the rate of displacement of the upper roller relative to the feed rate of wedge wire between the roller 202, 204.

Figure 18:
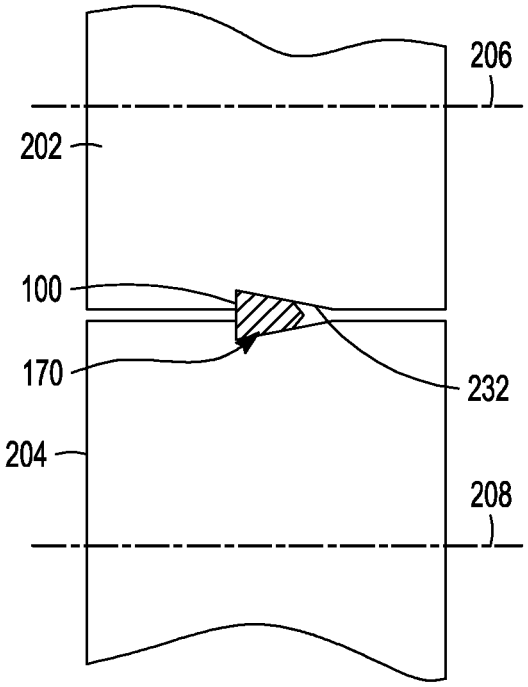
FIG. 18 is a cross-sectional view of the rollers of the rolling machine of FIG. 16 in a start position.

FIG. 18 shows the upper roller 202 at a start position when forming the wire 100. The upper roller 202 is spaced from the lower roller 204. The wide end 170 of the wire 100 is located between the rollers 202, 204 in the start position. The wide end 170 has the shape of the pre-formed feed wire fed between two rollers 202,204.

Figure 19:
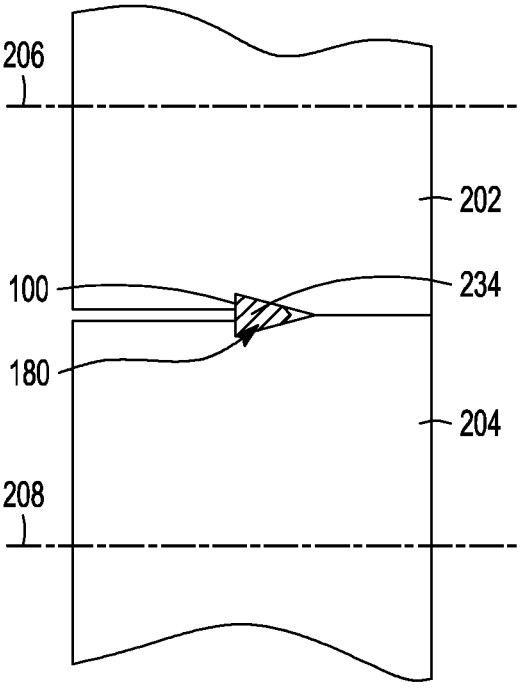
FIG. 19 is a cross-sectional view of the rollers of the rolling machine of FIG. 16 in an end position.

FIG. 19 shows the upper roller 202 at an end position wherein the upper roller 202 has been displaced to be substantially against the lower roller 204. The narrow end 180 of the wedge wire 100 is located between the rollers 202, 204 in the end position.

In one example, the upper roller 202 is displaced 0.88 mm from the start position to the end position over 750 mm of travel of feed wire between the roller 202, 204. That is to say that between the start position and the end position, the upper roller 202 moves about 0.11733 . . . mm closer to the lower roller 204 for every 100 mm of pre-formed feed wire fed between the rollers. In the example, the head width of the wedge wire 100 decreases from 3 mm to 2.12 mm over 750 mm. The decrease in head width is at a constant rate over the length of the wedge wire 100. The depth of the wedge wire 100 increases as the head width decreases. The depth of the wire 100 is 6.22 mm at the wide end 170 and 6.92 mm at the narrow end 180.

Figure 20:
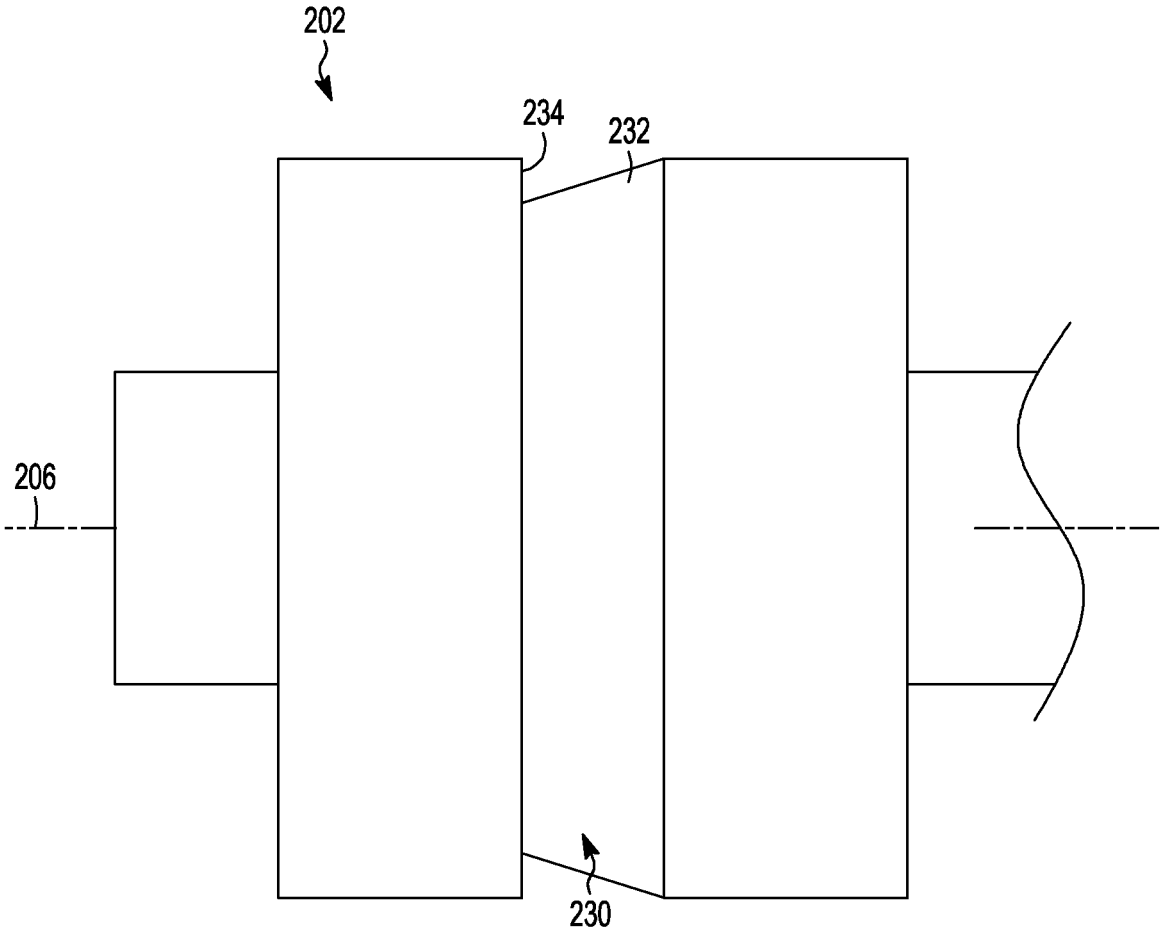
FIG. 20 is a front view of one of the rollers of the rolling machine of FIG. 16.

FIG. 20 shows a front view of the upper roller 202. The lower roller 204 is the same as the upper roller 202. The upper roller 202 is generally cylindrical and has an annular groove 230. The groove 230 has an inclined floor 232. The floor 232 is inclined at an acute angle of about 3 degrees relative to the rotational axis 206 of the roller 202. The floor 232 is tapered at about 3 degrees relative to the rotational axis 206. A shoulder face 234 of the groove 230 extends to the deepest end of the floor 232. The shoulder face 234 is square relative to the rotational axis 206. The lower roller 204 is the same as the upper roller 202.

In use, the body surface 122 or 132 of the wedge wire 100 is supported between the floors 232 of the grooves 230 with its head face against the shoulder faces 234 of the grooves 230.

Figure 21:
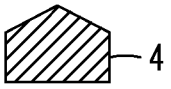
FIG. 21 is a cross-sectional view of one of the rods used in the screen basket of FIGS. 5 and 6.
Figure 22:
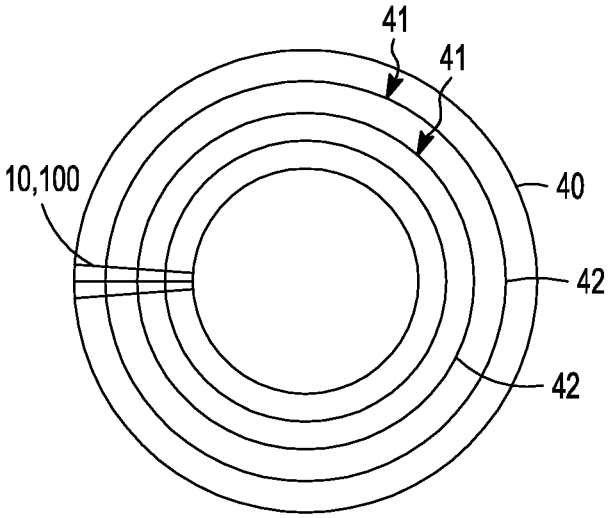
FIG. 22 is a top view of a rotating table on which wedge wires of FIGS. 12-15 and the rods of FIG. 21 are arranged for assembling the body of a screen basket.

The steps to manufacture a screen basket from either wedge wire 10 or 100 is described herein below as the process is the same irrespective of whether wedge wire 10 or 100 is used. Wedge wire 10, 100 is straightened and in one step may be placed in a rotating table 40 as shown in FIG. 22. Table 40 has a series of circumferential grooves 41 into which rods 42 are placed. The rods 42 have a cross-sectional shape as shown in FIG. 21, which resembles a house-like shape. The straightened wedge wire 10,100 is then laid across rods 42 as shown in FIG. 22 and welded to rods 42 as the wedge wire 10, 100 is located in position on table 40. Wedge wire 10, 100 may then be cut to the desired length and the table 40 rotated or indexed by a desired amount and the next series of wedge wires 10, 100 laid across and welded to rods 42. The wedge wire 10, 100 may then be cut and the process repeated until a frusto-conical body formed from rods 42 and wire 10 is formed with the mutually adjacent edges being welded to each other.

Figure 23:
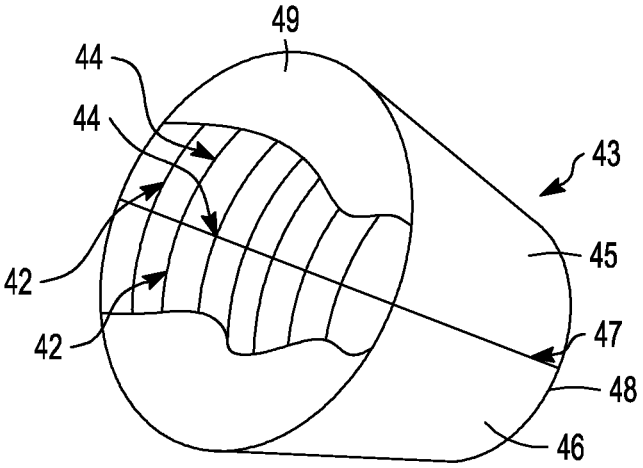
FIG. 23 is a perspective view of a conical jig used in assembling the body of a screen basket including the rods of FIG. 22.

Alternatively, use may be made of a split conical jig 43 shown in FIG. 23 which would be formed from heavy steel and machined to the desired shape with a series of circumferential grooves 44 which would retain rods 42 having a cross-sectional shape as shown in FIG. 23. The jig 43 would be split into two components 45 and 46. The two components 45,46 are releasably joined at join line 47. This may allow loading of rods 42 into retaining grooves 44. This would also allow for removal of the completed body from jig 43.

Figure 24:
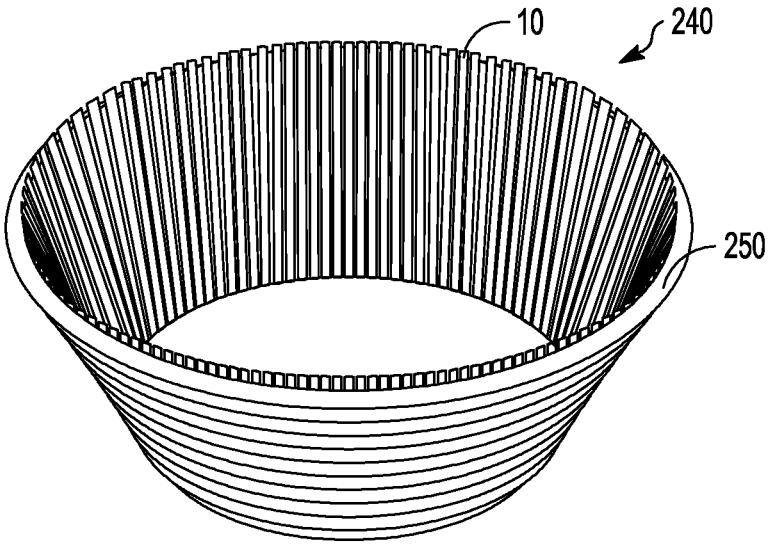
FIG. 24 shows a perspective view of the body of a screen basket including a multiplicity of wedge wires of FIG. 1 and support rods.

Alternatively, a screen basket 240, shown in FIG. 24, may be formed from a support rod in the form of an support hoop 250 which is formed from heavy steel and machined to the desired shape to receive a plurality of wedge wires 10 as described above. It will be appreciated that wedge wire 100 as described herein could also be used with the toothed hoop 240.

Figure 25:
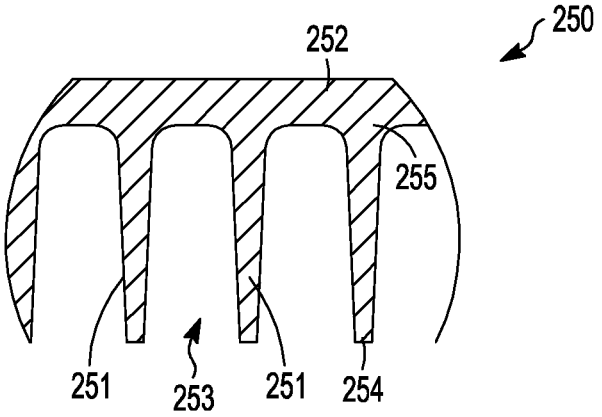
FIG. 25 shows a plan view of a segment of a support rod of FIG. 24.

The support hoop 250, shown in more detail in FIG. 25, has a series of circumferentially located spaced teeth 251 projecting inwardly from the annular body 252 of the support hoop 250. A recess 253 is defined by each pair of adjacent teeth 251 and retains a wedge wire. Each tooth 251 has a narrow end 254 distally located from the annular body 252 and a broad end 255 proximally located from the annular body 252. The narrowing from the broad end 255 to the narrow end 254 is uniform. The broad end 255 ensures the wedge wire (not shown) is held in the recess 253 against the annular body 252. In some embodiments, each tooth 251 has a width of approximately 0.61 cm.

Alternatively, a plurality of individual frusto-conical segments may be formed and then connected together to form the frusto-conical body. The segments may be connected to each other using any suitable affixing means, such as bolting or welding. Each segment may be constructed as a flat panel first and then curved to the desired frusto-conical segment shape. The plurality of segments may include at least 4 segments, more particularly at least 8 segments, and even more particularly 12 segments. However, it will be appreciated that the number of segments may be varied according to the size and shape of the desired frusto-conical body.

In practice, wedge wire 10, 100 is laid across rods 42 as shown in FIG. 22 and this may be done manually or automatically. A wire guide or carrier (not shown) would carry or progress wire 10, 100 to the small end 48 of jig 43 and set it in the desired position wherein subsequently it would be welded to rods 42. As the carrier is withdrawn from smaller end 48 to larger end 49, the wire 10 would then be cut to the correct length and the cone jig 43 would then be rotated or indexed on appropriate support bearings (not shown) to the desired location for the next series of wedge wires 10 to be laid across rods 42 and welded thereto. This process would be completed until the body of the centrifuge basket is completed.

It will be appreciated from the foregoing with the wires 10, 100 having the cross-sectional shapes described above, that centrifugal screen basket body 19 may be produced having a longitudinal slot 27 of uniform or constant width which is also in a common plane with the rotational axis of body 19. This means that coal particles included in a slurry being processed by centrifugal screen basket body 19 will travel from one end 24 to the other end 25 on tapered head face 11, thereby reducing fracturing and providing a greater harvest of coal from processing of the coal slurries.

It will be appreciated from the foregoing that because each wedge wire and thus each longitudinal slot is in a common plane with the rotational axis of the frusto-conical body, and also each slot has a constant width, that fracturing of particles in coal slurries is substantially reduced and thus the magnitude of the coal harvest from the processing of coal slurries is considerably increased.

The invention claimed is:

1. A screen basket for centrifuges, the screen basket comprising a body of frusto-conical shape, the body comprising a plurality of wire members and a plurality of support rods, wherein each of the wire members is oriented in a common plane with a rotational axis of the body, the support rods are oriented circumferentially of the body, the wire members are spaced apart to define longitudinal slots located between adjacent wire members, each of the wire members has a broad end and an opposite narrow end, each of the wire members narrows in width from the broad end to the narrow end, and each of the wire members increases in depth from the broad end to the narrow end.

2. The screen basket as claimed in claim 1, wherein each of the support rods has a plurality of teeth spaced around an annulus of the support rod, wherein each pair of adjacent teeth defines a recess for receiving one of the wire members.

3. The screen basket as claimed in claim 1, wherein the longitudinal slots located between adjacent wire members are of a constant width.

4. The screen basket as claimed in claim 1, wherein the longitudinal slots located between adjacent wire members are of a varying width within each slot.

* * * * *